US008499842B2

(12) United States Patent
Nguyen et al.

(10) Patent No.: US 8,499,842 B2
(45) Date of Patent: Aug. 6, 2013

(54) DUAL BARRIER PLUG SYSTEM FOR A WELLHEAD

(75) Inventors: Khang Van Nguyen, Houston, TX (US); Martin Anthony Trumbull, Cypress, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 387 days.

(21) Appl. No.: 12/855,543

(22) Filed: Aug. 12, 2010

(65) Prior Publication Data

US 2011/0036596 A1 Feb. 17, 2011

Related U.S. Application Data

(60) Provisional application No. 61/233,382, filed on Aug. 12, 2009.

(51) Int. Cl.
*E21B 33/03* (2006.01)

(52) U.S. Cl.
USPC ..... 166/386; 166/85.3; 166/135

(58) Field of Classification Search
USPC ..... 166/75.14, 85.3, 90.1, 135, 386
See application file for complete search history.

(56) References Cited

U.S. PATENT DOCUMENTS

| | | | | |
|---|---|---|---|---|
| 4,058,162 | A | 11/1977 | Smith | |
| 4,825,945 | A | 5/1989 | Smith | |
| 2003/0205385 | A1* | 11/2003 | Duhn et al. | 166/380 |
| 2006/0185841 | A1 | 8/2006 | Swagerty et al. | |

FOREIGN PATENT DOCUMENTS

| | | |
|---|---|---|
| GB | 643 186 | 9/1950 |
| WO | WO 2009/067298 | 5/2009 |
| WO | WO 2009/085780 | 7/2009 |

OTHER PUBLICATIONS

Special Products—Frac Isolation System brochure by Wood Group Pressure Control.
International Search Report—PCT/US2010/045344.

* cited by examiner

*Primary Examiner* — William P Neuder
*Assistant Examiner* — Richard Alker
(74) *Attorney, Agent, or Firm* — Bracewell & Giuliani LLP

(57) ABSTRACT

A dual barrier plug system includes a frac spool, having a dual barrier plug disposed within the interior of the frac spool; a valve selector member disposed within the interior of the dual barrier plug; and the plurality of seals are used to seal fluid flow from below the frac spool, and the seals provide two barriers to each fluid flow.

18 Claims, 5 Drawing Sheets

DUAL BARRIER PLUG SYSTEM FOR A WELLHEAD

RELATED APPLICATION

This application claims the benefit, and priority benefit, of U.S. Patent Application Ser. No. 61/233,382, filed Aug. 12, 2009, entitled "DUAL BARRIER PLUG SYSTEM FOR A WELLHEAD".

BACKGROUND

1. Field of the Disclosure

This disclosure relates to a dual barrier plug system for use with a wellhead during well fracturing operations.

2. Background of the Invention

In high pressure natural gas fields, well operators may use well fracturing, or "frac", operations or techniques to break up shale rock in the formation to release the natural gas to be produced from the well. The frac fluid, or fracturing fluid, is typically a mixture of water and a proppant, which is pumped down the wellbore through a "frac tree", or a series of large bore valves mounted on top of the wellhead for the well. Typically, the frac tree will include a lower master valve ("LMV") at the bottom of the frac tree.

BRIEF SUMMARY

In accordance with the illustrative embodiments hereinafter described, the present dual barrier plug system, for use with a wellhead having a first tubular member having a first interior bore, may include: a second tubular member having a second interior bore; a dual barrier plug, having a third interior bore, the dual barrier plug being received within the second interior bore of the second tubular member; a valve selector member being received, and selectively movable within the third interior bore of the dual barrier plug; a lower seal associated with the lower end of the dual barrier plug adapted to provide a seal between the outer wall surface of the dual barrier plug and the first interior bore of the first tubular member; and an upper seal associated with the upper end of the dual barrier plug, disposed between the outer wall surface of the dual barrier plug and the second interior bore of the second tubular member, and disposed between the outer wall surface of the valve selector member and the third interior bore of the dual barrier plug, whereby upward fluid flow from below the lower end of the dual barrier plug may be prevented by the upper and lower seals.

BRIEF DESCRIPTION OF THE DRAWING

The present dual barrier plug system may be understood by reference to the following description taken in conjunction with the accompanying drawing, in which.

Figure 1:
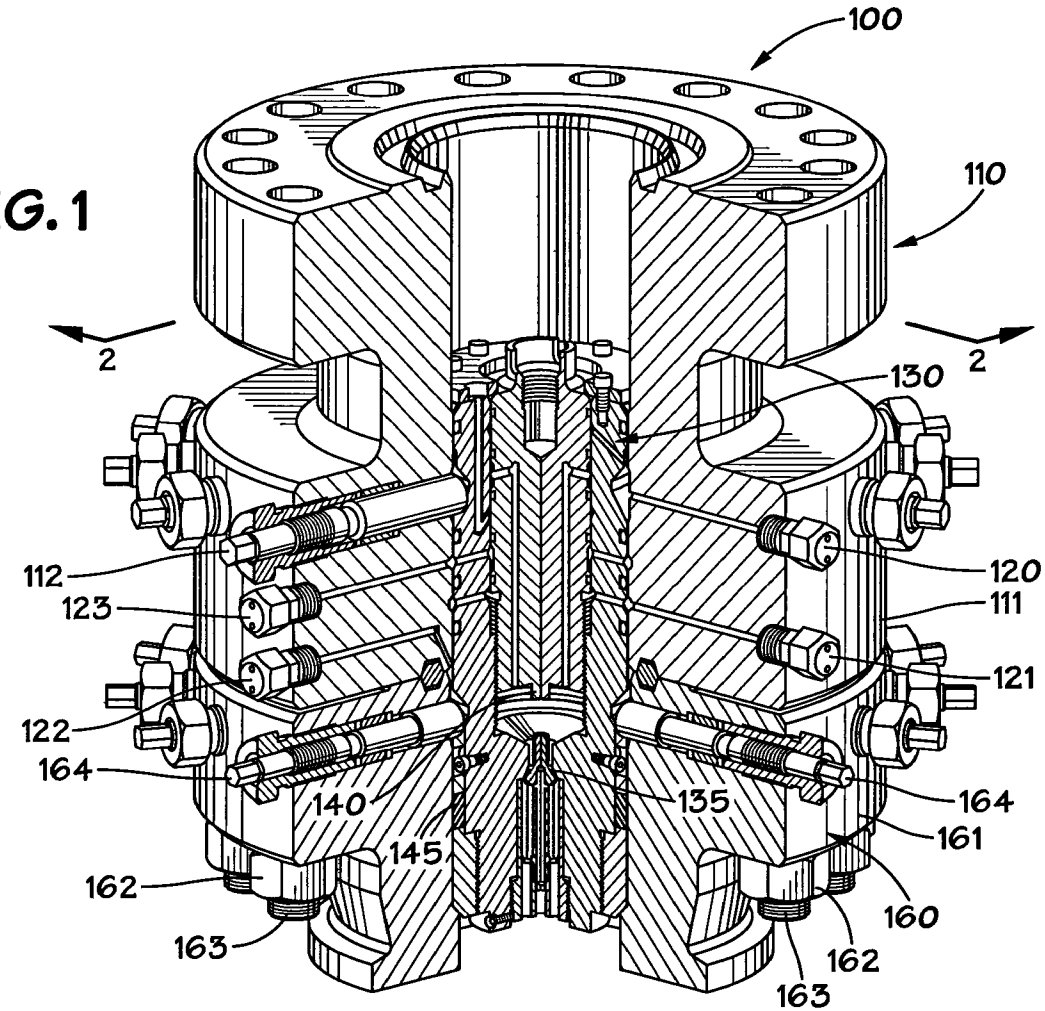
FIG. 1 is a perspective, cut-away view of an illustrative embodiment of a dual barrier plug system.

While certain embodiments of the present dual barrier plug system will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION OF THE SPECIFIC EMBODIMENTS

Figure 2:
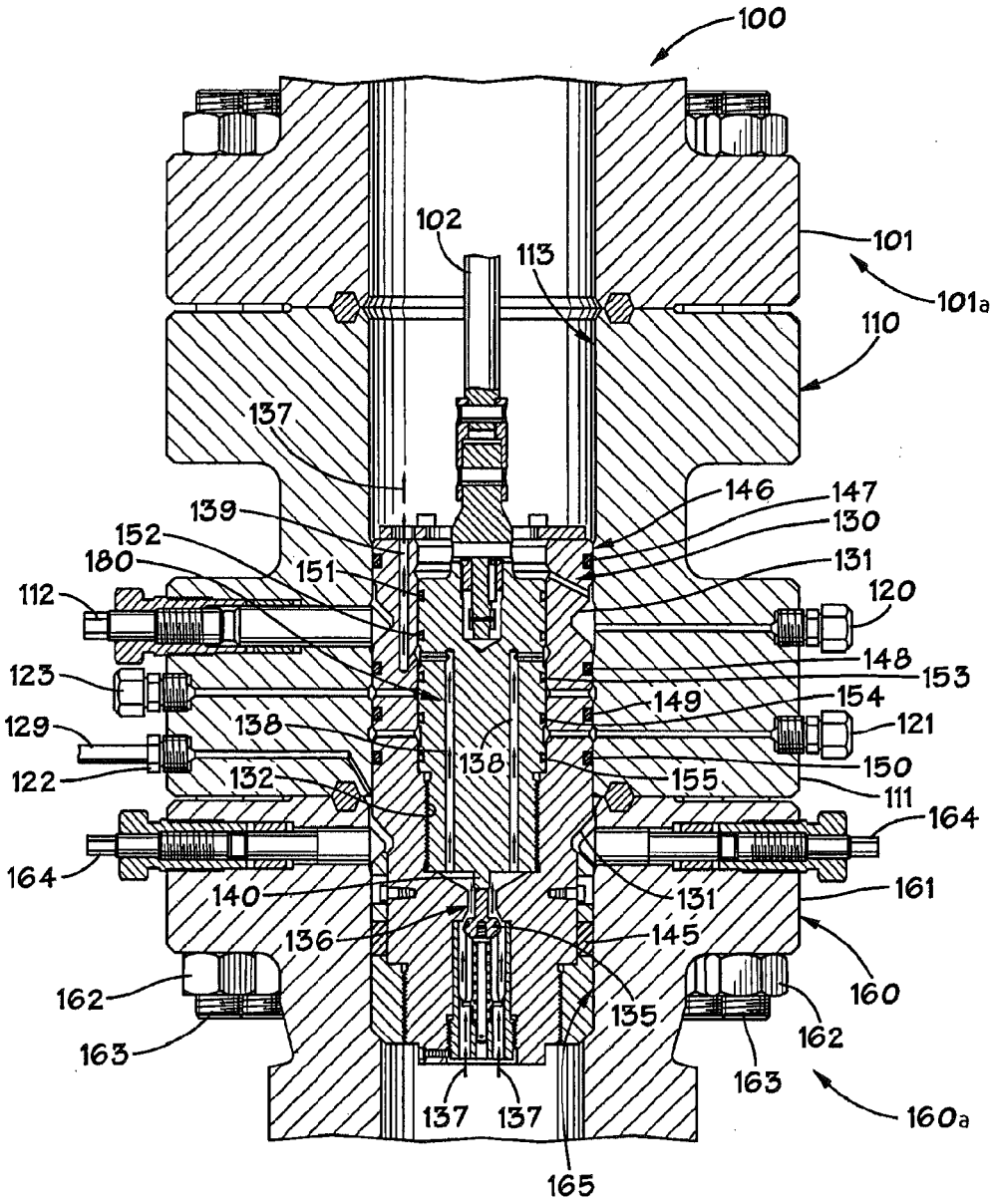
FIG. 2 is a partial cross-sectional view of the dual barrier plug system of FIG. 1, including a dual barrier plug running tool, taken along line 2-2 of FIG. 1, wherein a valve disposed in the dual barrier plug is disposed in its open, fluid-transmitting relationship.
Figure 3:
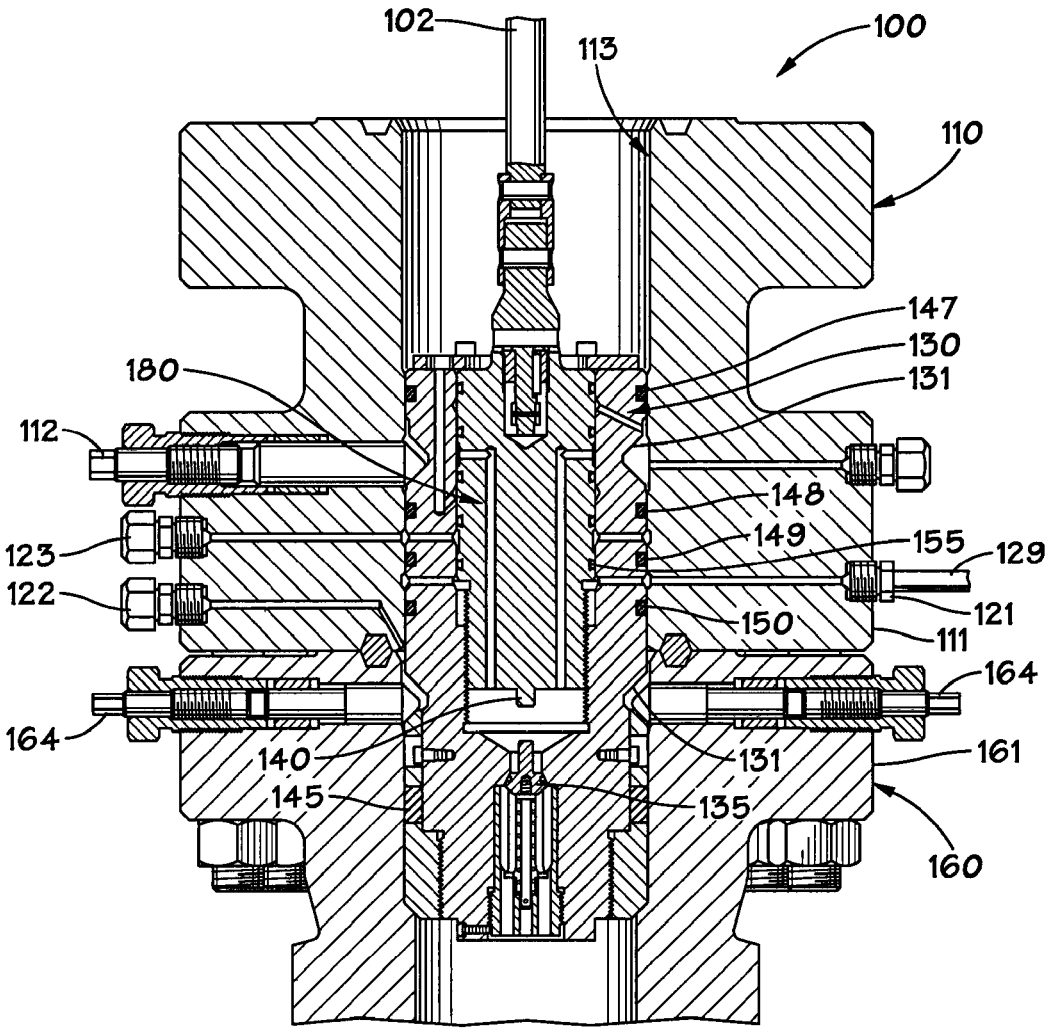
FIGS. 3-4 are partial cross-sectional views of the dual barrier plug system of FIG. 1, including a dual barrier plug running tool, taken along line 2-2 of FIG. 1, wherein a valve disposed in the dual barrier plug is disposed in its closed configuration.
Figure 4:
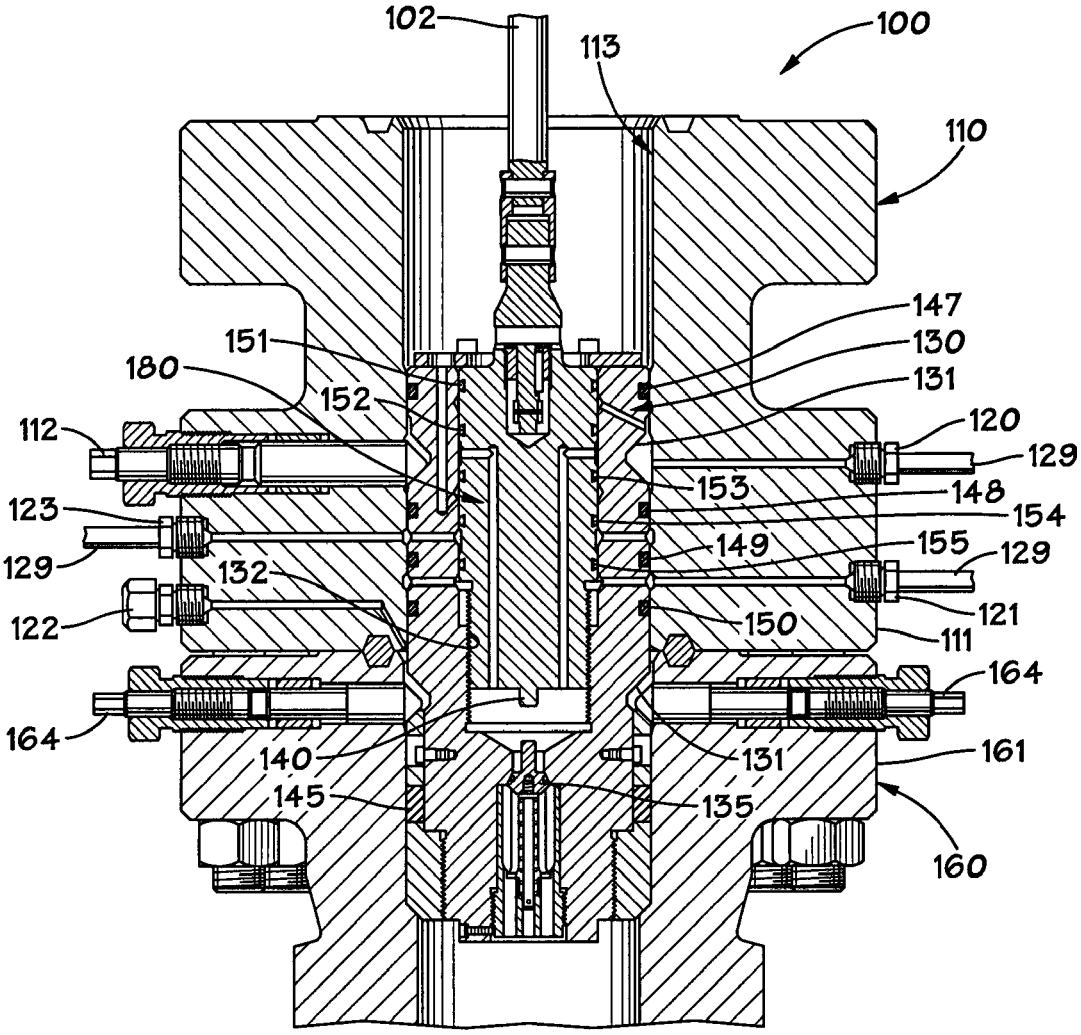

With reference to FIGS. 1-4, an illustrative embodiment of a dual barrier plug system 100 is illustrated, which is intended for use with a fracturing tree, or "frac tree" 101*a*, having a lower main valve 101 (FIG. 2) disposed adjacent the lower end of the frac tree 101*a* (not shown in entirety). Dual barrier plug system 100 generally includes: a dual barrier tree adapter, or frac spool, 110; a dual barrier plug, or plug member, 130; and a valve selector member, or port selector valve member, 180 (FIGS. 2-4). As shown in FIG. 2, the lower master valve 101 (schematically shown in FIG. 2) is associated with the lower end of the conventional frac tree 101*a* (not shown in entirety), and lower master valve 101 is associated with a tubular member, or the dual barrier tree adapter, or frac spool, 110 in a conventional manner. Below frac spool 110 is disposed a tubular member, or a conventional tubing spool, or tubing head, 160, of a wellhead 160*a* (not shown in entirety). Preferably, the internal diameters of the frac spool 110 and the tubing spool 160 are substantially the same.

The upper flange 161 of tubing spool 160 may be bolted in a conventional manner to the lower flange member 111 of frac spool 110, as by a plurality of nuts and bolts 162, 163. Frac spool 110 preferably includes a plurality of lockdown screws, or locking bolts, 112 disposed within the lower flange 111 in communication with the interior bore 113, having an interior wall surface, of frac spool 110. The lockdown screws 112 are adapted for engagement, in a conventional manner, with dual barrier plug 130, as will be hereinafter described. Similarly, tubing spool 160 is also provided with a plurality of lockdown screws, or locking bolts, 164 disposed in the upper flange 161 of tubing spool 160 which pass into the interior, or internal, bore, or tubing head bowl, 165 of tubing spool 160. Interior bore 165 also has an interior wall surface. Lockdown screws 164 are also adapted to engage dual barrier plug 130 in a conventional manner, whereby lockdown screws 112 and 164 releasably secure dual barrier plug 130 within the dual barrier plug system 100. The lockdown screws are located to engage suitable grooves, or chamfered grooves, 131 formed on the outer surface of dual barrier plug 130.

Still with reference to FIGS. 1-4, dual barrier plug system preferably includes a plurality of conventional test ports, such as test ports 120-123 disposed within the lower flange 111 of frac spool 110, and the test ports 120-123 are in fluid communication with the interior bore 113, having an interior wall surface, of frac spool 110 as will be hereinafter described.

Figure 5:
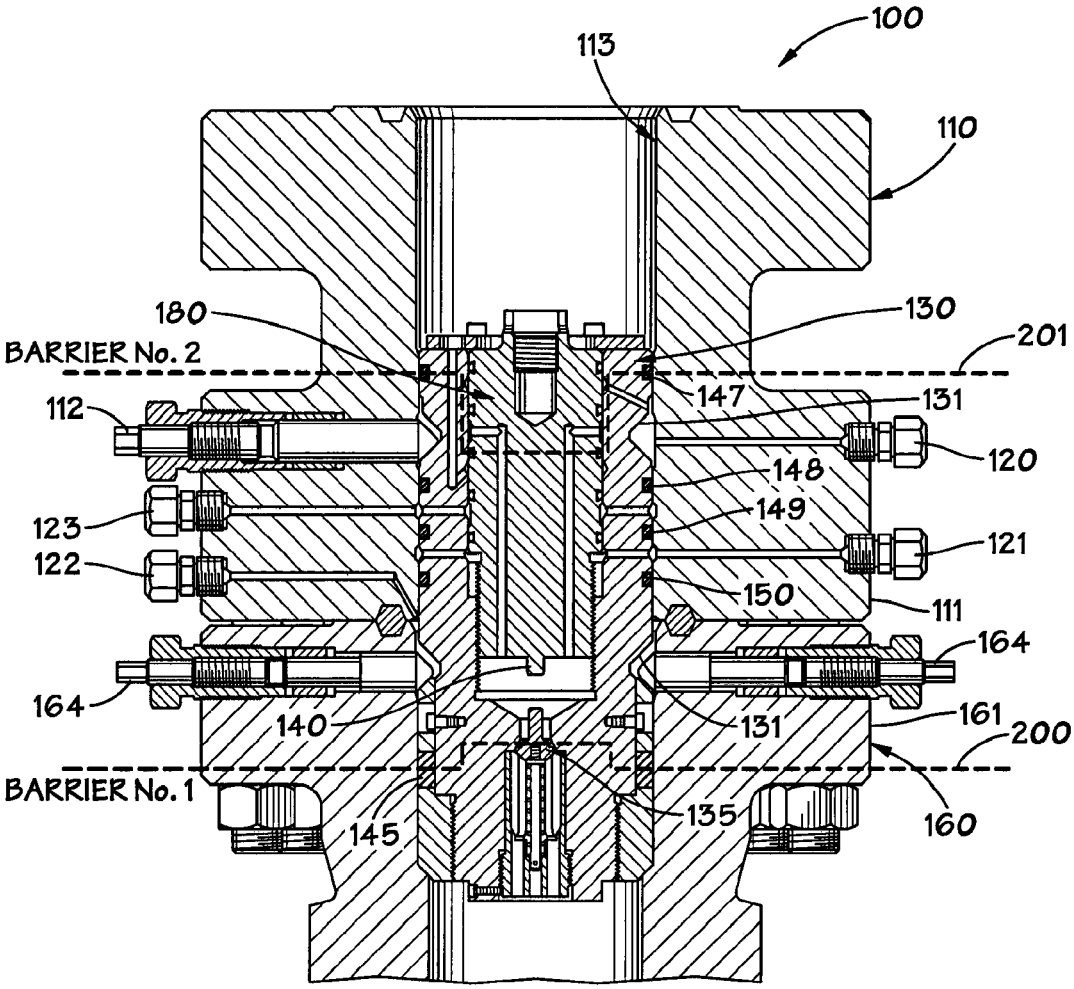
FIG. 5 is a partial cross-sectional view of the dual barrier plug system of FIG. 1 taken along line 2-2, and illustrates the two seal barriers provided by the present dual barrier plug system.

With reference to FIGS. 2-4, the port selector valve member 180 is disposed within an internal, or interior, bore 132, having an internal wall surface, of dual barrier plug 130, and valve member 180 is adapted for relative movement upwardly, or downwardly, within the internal bore 132 of dual barrier plug 130. The dual barrier plug running tool, or running tool, 102 may be utilized to provide the desired relative movement of port selector valve member 180 with respect to dual barrier plug 130, as well as provide for the initial disposition of dual barrier plug 130 within dual barrier system 100, as will be hereinafter described. Running member 102 may releasably engage with the upper end of the port selector valve member 180 of dual barrier plug 130 in any conventional manner, whereby running tool 102 may be engaged within, and disengaged from, dual barrier plug 130. As seen in FIG. 5, the running tool 102 has been disengaged from the upper end of dual barrier plug 130.

With reference to FIGS. 1-4, dual barrier plug 130 is illustrated to include a poppet valve 135 disposed within an annular bore 136 in the lower end of dual barrier plug 130. In FIG. 2, poppet valve 135 is disposed in its open configuration, which is caused by the downward movement of port selector valve member 180 being moved downwardly by running tool 102 moving downwardly to move port selector valve 180 into engagement with the top of poppet valve 135, whereby fluid, as shown by arrows 137, may be transmitted, or pass through, various fluid passageways 138 disposed within port selector valve member 180 and fluid passageways 139 formed within dual barrier plug 130. Preferably a valve actuator member, or stinger member, or protrusion, 140 disposed upon the lower end of port selector valve member 180, engages, or abuts, the upper end of poppet valve 135 to actuate, or move downwardly, poppet valve 135 to open it. Thus, upon running tool 102 moving downwardly and causing downward movement of port selector valve 180 to engage poppet valve 135, via stinger member 140, internal pressure within the wellhead 160*a* below dual barrier plug system 100 may be relieved and passed upwardly through dual barrier system 100, if desired. As seen in FIG. 2, when poppet valve 135 is in its open position, caused by the downward movement of port selector valve member 180, the fluid passageways 138 and 139, and their related ports, are in a mating, fluid transmitting relationship.

With reference to FIGS. 3-5, poppet valve 135 is closed, as stinger member, or protrusion, 140 disposed upon the lower end of port selector valve member 180 does not engage with, or abut and move, the upper end of poppet valve 135. Poppet valve 135 is thus in a sealed abutting, non-fluid transmitting relationship with respect to bore 136. Running tool 102, by having moved upwardly causes the port selector valve member 180 to be in the configuration illustrated in FIGS. 3-5, whereby the fluid passageways 138 and 139 are not in a mating, fluid transmitting relationship. Although a poppet valve 135 is illustrated, other types of valves could be utilized in plug member 130.

With reference to FIGS. 1-4, dual barrier plug 130 has a lower packing set, or primary body seal, 145 disposed on its outer wall surface, or outer circumference. Seal 145 is adapted to be in a sealed relationship between the outer wall surface of the lower end of dual barrier plug 130 and the interior wall surface, or interior bore, 165 of tubing spool, or tubing head bowl, 160. Lower packing set 145 may be a plurality of individual seals or packings, or may be a single seal member. Dual barrier plug 130 is also preferably provided with an upper seal, or upper packing set, 146 which includes a plurality of seals 147-150 disposed about the outer wall surface of dual barrier plug 130 to provide additional sealing between the outer wall surface of dual barrier plug 130 with respect to the interior bore 113 of frac spool 110.

Upper packing set 146 also preferably includes a plurality of seals 151-155 disposed between the outer wall surface of port selector valve member 180 and the interior bore 132 of dual barrier plug 130. While upper packing set 146 is shown to include four exterior seals 147-150 and five interior seals 151-155, any desired number of individual seals could be utilized, and such seals may be of any suitable construction and material, provided they have the requisite strength and sealing characteristics to afford the desired sealing in the dual barrier plug system 100 for use with a wellhead 160*a* and frac tree 101*a* (both not shown in entirety).

As seen in FIG. 2, test port 122 may be opened and connected to a conventional pressure gauge (not shown), as by attaching tubing 129 in fluid communication with the pressure gauge (not shown) to test the sealing integrity of the seal of the lower packing set 145, in a conventional manner. As test port 122 is in fluid communication with the annular space between dual barrier plug 130 and tubing spool 160, above primary seal 145, should seal 145 not afford a proper seal to isolate wellbore pressure from the wellhead 160*a* below tubing spool 160, such a leak could be determined from the pressure gauge (not shown) connected to test port 122.

With reference to FIG. 3, test port 121 may be utilized to monitor the integrity of the seal of poppet valve 135 with respect to bore 136, as test port 121 is in fluid communication with the annular space between port selector valve member 180 and the internal bore 132 of dual barrier plug 130 disposed below seal 155, whereby if poppet valve 135 is leaking, such leak will be detected in a conventional manner.

With reference to FIG. 4, test port 123 may be utilized to test the integrity of seals 148, 149, and seals 153, 154. Test port 120 may be utilized to monitor for leakage between seals 147 and 148. Test port 121 may be utilized to monitor for leakage between seals 149, 150. Test port 120 may also be utilized to test the integrity of seals 147 and 148 and seals 151, 152, in a conventional manner.

With reference to FIG. 5, wherein poppet valve 135 is disposed in its closed relationship, the dual seal barriers 200, 201 of dual barrier plug system 100 are illustrated. The first seal barrier 200 is provided by the lower packing set, or primary body seal, 145 as previously discussed. The second seal barrier 201 is provided by at least some of the seals, and preferably all of the seals, of the upper packing set 146, or seals 147-155 (FIGS. 2-4) by upper packing set 146 sealing on the outer wall surface of dual barrier plug 130 and its sealing between port selector valve member 180 and the internal bore 132 of dual barrier plug 130.

If a sealing failure occurs in the frac tree 101*a* (not shown in entirety), as for example caused by a leaking lower master valve 101 (FIG. 2), the wellbore pressure present in the well below tubing spool 160 may be isolated from the frac tree 101*a* to permit removal of the frac tree 101*a* under pressure if such removal is needed. Upon determining that the frac tree 101*a* must be removed, such as to be able to remove a leaking master valve 101, dual barrier plug 130 and its associated port selector valve member 180 would be run through the frac tree 101*a* by use of running tool 102 within a conventional lubricator (not shown) until dual barrier plug 130 is disposed within the frac spool 110 and tubing spool 160 as illustrated in FIGS. 3-4. Lockdown screws 112 and 164 would be engaged with dual barrier plug 130, as previously described. Thereafter, running tool 102 and its associated lubricator (not shown) would be removed, thus leaving the wellbore pressure isolated below the frac tree 101*a* by the dual barrier plug 130 as shown in FIG. 5. The frac tree 101*a* may then be removed whereby, for example, a leaking master valve 101 could be safely removed and replaced.

The dual barrier tree adapter, or frac spool, 110 when not used with the dual barrier plug 130, as previously described, may be utilized in normal frac operations, to releasably secure a frac sleeve (not shown) within bores 113 and 165, to protect the tubing spool, or tubing head bowl 160 from erosion and wear damage from the frac fluid.

Specific embodiments of the present dual barrier plug system have been described and illustrated. It will be understood to those skilled in the art that changes and modifications may be made without departing from the spirit and scope of the inventions defined by the following claims.

We claim:

1. A dual barrier plug system, for use with a wellhead having a first tubular member having a first interior bore, comprising:

a second tubular member, having an upper and a lower end, associated with the first tubular member, the second tubular member having a second interior bore;

a dual barrier plug, having an upper and a lower end, an outer wall surface, a third interior bore, and a valve associated with the lower end of the dual barrier plug, the valve, upon actuation, providing selective fluid flow to the third interior bore of the dual barrier plug, and the dual barrier plug being received within the second interior bore of the second tubular member;

a valve selector member having an upper end and a lower end, and an outer wall surface, the valve selector member being received, and selectively moveable within the third interior bore of the dual barrier plug, the valve selector member including a valve actuator member to actuate the valve associated with the dual barrier plug;

a lower seal associated with the lower end of the dual barrier plug adapted to provide a seal between the outer wall surface of the dual barrier plug and the first interior bore of the first tubular member;

an upper seal associated with the upper end of the dual barrier plug, disposed between the outer wall surface of the dual barrier plug and the second interior bore of the second tubular member, and disposed between the outer wall surface of the valve selector member and the third interior bore of the dual barrier plug, whereby upward fluid flow from below the lower end of the dual barrier plug may be prevented by the upper and lower seals; and a running tool which moves the dual barrier plug and the valve selector member into the second tubular member, and which moves the valve selector member within the dual barrier plug to open the valve associated with the dual barrier plug.

2. The dual barrier plug system of claim 1, wherein the first tubular member is a tubing spool associated with the wellhead.

3. The dual barrier plug system of claim 1, wherein the second tubular member is a frac spool.

4. The dual barrier plug system of claim 1, wherein the first interior bore has a first internal diameter and the second interior bore has a second internal diameter, and the first and second internal diameters are substantially equal to each other.

5. The dual barrier plug system of claim 1, wherein the second tubular member includes at least one test port in fluid communication with the second interior bore of the second tubular member.

6. The dual barrier plug system of claim 1, wherein the second tubular member includes at least one test port in fluid communication with the third interior bore of the dual barrier plug.

7. The dual barrier plug system of claim 1, including a plurality of lock-down screws associated with the second tubular member to releasably secure the dual barrier plug within the second tubular member.

8. The dual barrier plug system of claim 1, wherein the upper seal includes a plurality of individual seals.

9. The dual barrier plug system of claim 1, wherein the valve is a poppet valve disposed in the lower end of the dual barrier plug.

10. The dual barrier plug system of claim 1, wherein the dual barrier plug includes at least one fluid passageway in fluid communication between the second interior bore of the second tubular member and the third interior bore of the dual barrier plug; and the valve selector member has at least one fluid passageway in selective fluid communication with the at least one fluid passageway of the dual barrier plug, upon relative movement between the dual barrier plug and the valve selector member.

11. A method for providing two barriers to prevent upward fluid flow from a wellhead through a frac tree having a lower master valve and a tubing spool, disposed beneath the lower master valve, the tubing spool having a first interior bore, comprising:

providing a tubular member, having an upper and a lower end and a second interior bore, between the lower master valve and the tubing spool;

disposing a dual barrier plug within the second interior bore of the tubular member;

disposing a valve selector member within the third interior bore of the dual barrier plug, the valve selector member having an upper end and a lower end, and an outer wall surface;

associating a lower seal with the lower end of the dual barrier plug to provide a seal between the outer wall surface of the dual barrier plug and the first interior bore of the tubing spool;

associating an upper seal with the upper end of the dual barrier plug, between the outer wall surface of the dual barrier plug and the second interior bore of the tubular member, and between the outer wall surface of the valve selector member and the third interior bore of the dual barrier plug;

preventing upward fluid flow from below the lower end of the dual barrier plug by the sealing of the upper and lower seals about the outer wall surface of the dual barrier plug and about the outer wall surface of the valve selector member; and utilizing a running tool to move the dual barrier plug and the valve selector member into the tubular member.

12. The method of claim 11, including utilizing as the tubular member a frac spool.

13. The method of claim 11, including providing the tubular member with at least one test port in fluid communication with the second interior bore of the tubular member, and testing the sealing integrity of the upper seal.

14. The method of claim 11, including providing the tubular member with at least one test port in fluid communication with the third interior bore of the dual barrier plug, and testing the sealing integrity of the upper seal.

15. The method of claim 11, including utilizing a plurality of lock-down screws associated with the tubular member to releasably secure the dual barrier plug within the tubular member.

16. The method of claim 11, including utilizing as the upper seal a plurality of individual seals.

17. The method of claim 11, including providing the dual barrier plug with a valve associated with the lower end of the dual barrier plug; and selectively actuating the valve, to provide selective fluid flow to the third interior bore of the dual barrier plug, by moving the valve selector member to actuate the valve.

18. The method of claim 11, including providing the dual barrier plug with at least one fluid passageway in fluid communication between the second interior bore of the tubular member and the third interior bore of dual barrier plug; providing the valve selector member with at least one fluid passageway, and selectively putting the at least one fluid passageways in fluid communication with each other by providing relative movement between the dual barrier plug and the valve selector member.

* * * * *